United States Patent [19]

Mraz

[11] Patent Number: 4,784,522

[45] Date of Patent: Nov. 15, 1988

[54] METHOD AND APPARATUS FOR EFFECTING HIGH PRESSURE ISOLATION OF LIQUIDS

[76] Inventor: Dennis Mraz, 410 Jessop Ave., Saskatoon, Saskatchewan, Canada, S7N 2S5

[21] Appl. No.: 89,726

[22] Filed: Aug. 26, 1987

Related U.S. Application Data

[63] Continuation-in-part of Ser. No. 930,424, Nov. 14, 1986.

[51] Int. Cl.[4] ..... E21D 9/00

[52] U.S. Cl. ..... 405/132; 405/288; 299/11

[58] Field of Search ..... 405/132, 144, 150, 230, 405/288, 289; 299/10, 11, 12, 19

[56] References Cited

U.S. PATENT DOCUMENTS

| | | | |
|---|---|---|---|
| 2,976,691 | 3/1961 | Edholm . | |
| 3,068,654 | 12/1962 | Warren | 405/132 X |
| 3,422,627 | 1/1969 | Courte . | |
| 3,817,039 | 6/1974 | Stewart et al. . | |
| 3,925,992 | 12/1975 | Backstrom . | |
| 4,008,576 | 2/1977 | Meyer et al. | 299/12 X |
| 4,036,024 | 7/1977 | Dreker et al. | 405/144 X |
| 4,124,985 | 11/1978 | Maimets | 405/150 |
| 4,294,563 | 10/1981 | Kilburn | 405/132 |
| 4,315,657 | 2/1982 | Burton, III | 405/132 X |
| 4,484,837 | 11/1984 | Kennedy et al. | 405/132 |

FOREIGN PATENT DOCUMENTS

| | | |
|---|---|---|
| 916458 | 12/1972 | Canada . |
| 928090 | 6/1973 | Canada . |
| 929362 | 7/1973 | Canada . |
| 944168 | 3/1974 | Canada . |
| 1112466 | 11/1981 | Canada . |
| 1126040 | 6/1982 | Canada . |

*Primary Examiner*—David H. Corbin

*Attorney, Agent, or Firm*—Welsh & Katz, Ltd.

[57] ABSTRACT

Various high pressure isolation structures are operative to prevent brine or other unwanted liquid from seeping through incompetent or soluble rocks. In one embodiment, a pair of barrier dams are constructed in spaced relation within an underground passageway, and the interface between each dam and the host rock is sealed. A hydrophobic liquid is introduced under pressure into the passageway between the dams so as to impregnate the microfracture system within the host rock. A monitoring installation may be employed to sample the area on the flood side of the upstream barrier dam. Alternate embodiments of isolation structures in the form of expandable bulkheads may be employed to effect accelerated rock repressurization so as to close the microfractures either individually or in combination with another barrier dam with hydrophobic liquid.

12 Claims, 2 Drawing Sheets

METHOD AND APPARATUS FOR EFFECTING HIGH PRESSURE ISOLATION OF LIQUIDS

This is a continuation-in-part from Ser. No. 930,424, filed Nov. 14, 1986.

BACKGROUND OF THE INVENTION

The present invention relates generally to the control of unwanted seepage in below-ground environments, and more particularly to a novel method and apparatus for effecting high pressure isolation of mine passageways and the like from liquid seepage.

Underground liquid seepage in mines and other below-ground chambers, such as underground storage facilities, has been a continual problem. Numerous attempts have been made to seal off passageways so as to prevent seepage of unwanted liquids. The problem is most acute where the host rock is an incompetent or soluble rock such as that found in saltrock or near potash deposits.

One known method employed to prevent such seepage involves pouring aggregates of fly ash and cement through a suitable entry to seal the passageway. This technique is only partially effective, however, since a certain amount of high pressure unsaturated brines and other unwanted liquid mobile substances migrate through the microfractures of the surrounding host rock and seepage continues.

A more recent technique for isolating unwanted liquids underground, and which finds particular application in underground rock cavities and reservoirs for storing nuclear residues, comprises surrounding a container for the residues with a viscous liquid such as bitumen or Bentonite having a density somewhat above that of water so that the viscous liquid effects a sealing action in cracks in the container and/or the surrounding rock formation. The container is spaced from the surrounding wall of the rock cavity by means of resilient or flexible supports. See, for example, U.S. Pat. No. 3,925,992. While the technique disclosed in the aforementioned patent is somewhat successful in dealing with underground seepage of pressurized liquids, it has not eliminated the problem.

The problem of underground seepage is particularly acute in deep potash mines, such as located in Canada, where flooding has occurred in salt rocks consisting of more than one mineral such as sylvite, carnallite, and halite. Even at very low pressures, unsaturated brine will frequently bypass an engineering barrier through cracks and fractures in the wall of the mine opening adjacent the barrier. In addition to bedding planes and other lithological discontinuities, there are fracture zones in the area subjected to stress concentrations during and after the excavation of an opening.

Prior to constructing a barrier, all fractured and otherwise potentially discontinuous material must be removed. However, even a complete removal of all such material will not prevent infiltration of brine into the stress relieved zones around the opening. Scanning electronic microscope photographs of potash specimens have shown that stress relieved potash rock is full of microcracks resulting from the difference in strains of the sylvite and halite crystals. Therefore, it has now become known that a successful design of an isolation structure should not only contain an impermeable seal at the interface of the rock and the dam or barrier, but should also prevent migration of the brine through microfracture systems in the vicinity of the isolation structure.

SUMMARY OF THE INVENTION

A primary object of the present invention to provide a novel method and apparatus for effecting high pressure isolation of underground cavities and the like so as to prevent migration of brine and other liquids through a microfracture system in the vicinity of the isolation apparatus.

Another object of the present invention is to provide, in one embodiment, an isolation structure for use in an underground rock passage or tunnel and which contains an impermeable seal operative to interface with the rock so as to prevent migration of brine through a microfracture system in the vicinity of the isolation structure.

Still another object of the present invention is to provide, in a further embodiment, an isolation dam in the form of an expansion joint which may be installed within an underground rock passage or tunnel relatively quickly so as to repressurize the surrounding rock and close the microfractures adjacent the isolation dam so as to prevent seepage therethrough.

In carrying out the first embodiment of the invention, the microfracture within an underground rock passage system in the vicinity of the isolation structure is impregnated with high pressure hydrophobic liquid. This is accomplished by constructing two barriers within the rock passage between which diesel fuel or other hydrophobic liquid is injected under pressure. A sump is located in the area between the two barriers to collect any brine which has seeped around or through the frist or upstream barrier. The brine is of greater specific gravity than the hydrophobic liquid, and therefore settles in the sump from where it can be withdrawn.

The aforementioned first embodiment therefor provides a method of isolating flooding liquid in an underground passage or tunnel formed in incompetent or soluble rock comprising the steps of (a) constructing a first liquid impervious barrier within the passageway, (b) constructing a second liquid impervious barrier within the passageway spaced from the first barrier, and (c) injecting a liquid into the area of the passageway between the spaced barriers under sufficient pressure to impregnate the surrounding microfracture.

In another aspect of the first embodiment of the invention there is provided a method for high pressure flood dam isolation of unsaturated brines in saltrock comprising the steps of removing all fractured or otherwise potentially discontinuous material in the wall of a mine opening, constructing first and second dams across the mine opening, sealing the host rock on the pressure side of the first or upstream dam, injecting hydrophobic medium under pressure between the first and second dams, sealing the microfracture system in the host rock around the first and second dams through rock repressurization, impregnating the microfracture system within the host rock with a hydrophobic medium, monitoring the fluid on the pressure side of the first barrier, and withdrawing any seepage of fluid from a sump located between the first and second dams.

In carrying out the second embodiment of the invention, an isolation dam or bulkhead is employed in an underground passageway or the like formed in an incompetent or soluble rock environment so as to prevent flooding by unwanted liquid substances. The isolation dam comprises an expansion joint structure having means enabling hydraulic expansion of dam members so as to pressurize the surrounding mircofracture system and prevent seepage therethrough.

Further objects, features and advantages of the invention together with the organization and manner of operation thereof, will become apparent from the following detailed description of the invention when taken in conjunction with the accompanying drawings wherein like reference numerals represent like elements throughout the several views.

DETAILED DESCRIPTION

Figure 1:
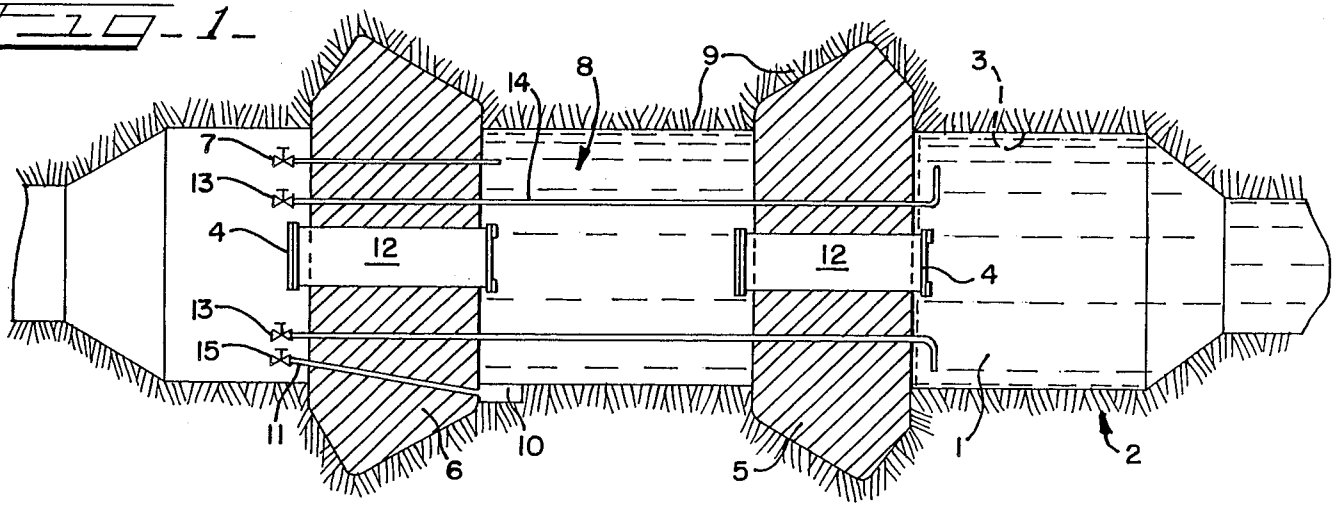
FIG. 1 is a longitudinal sectional view of a high pressure isolation structure in accordance with one embodiment of the invention located in a below-ground mining passageway.

FIG. 1 illustrates one embodiment of an isolation dam located in a passageway 1 formed in a deep mine of surrounding salt rock 2 or other incompentent or soluble rock and which is filled with unsaturated brine or high pressure water. The fragmented or broken salt rock 9 is removed around the area where a first dam 5 is to be installed. The dam 5 is made of an impervious material such as poured concrete. The high pressure side of the dam 5 in contact with the passageway full of brine adjacent surface of the passageway are coated with an elastomer liner 3. The function of the liner is to prevent penetration of brine to the rock adjacent the dam 5. A second dam 6 is constructed in a similar manner to the first dam 5 and spaced downstream therefrom. The area between the two dams is equipped in a sump 10 which is connected to a sump withdrawal passageway 11 having a valve 15. After the two dams have been constructed and are in place, pressurized diesel fuel or similar hydrophobic material 8 is injected by means of an injector 7 into the area between the two dams. Microcracks in the host rock 9 surrounding the open area between dams 5 and 6 are partly closed by pressure as well as filled with the hydrophobic liquid, thereby resisting the entry of high pressure brine through the cracks. Sampling mechanism including sampling valves 13 are connected through lines 14 to the high pressure water or unsaturated brine area 1. Access passages 12 are located within the dams 5 and 6 for maintenance or inspection purposes and pass generally centrally and horizontally therethrough. These access channels 12 are equipped with ports 4.

Once the construction thus far described is in place, the high pressure water or brine in are 1 can be monitored through the sampling mechanism 13 from time to time. If any brine enters into the area where the pressurized diesel fuel 8 is located, its higher specific gravity will cause it to fall to the bottom of the area into the sump 10. The sump valve 15 is turned on and the brine with drawn until diesel fuel appears. Thereafter, diesel fuel can again be injected through area 7 to maintain the correct pressure.

Figure 2:
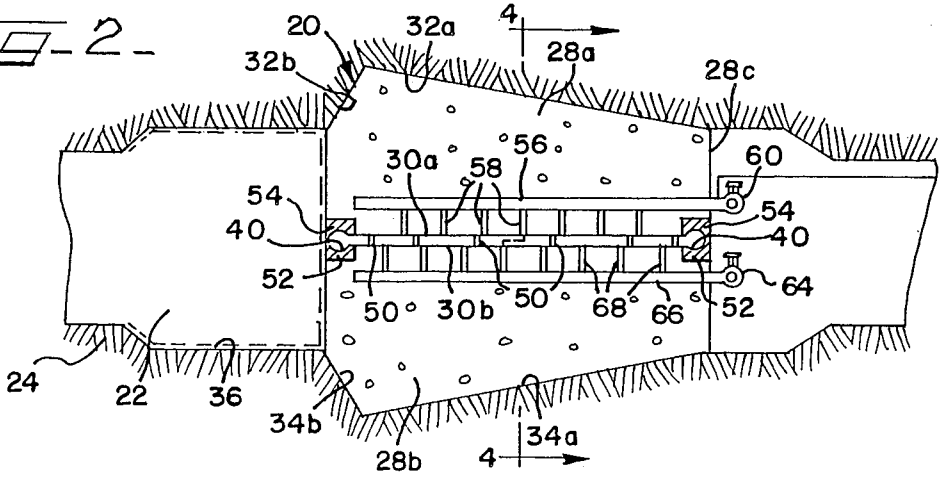
FIG. 2 is a longitudinal sectional view of another embodiment of a high pressure isolation structure in accordance with the invention located in an underground passageway.
Figure 3:
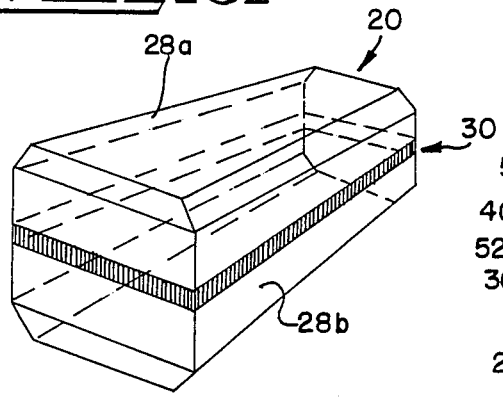
FIG. 3 is a perspective view diagrammatically illustrating the isolation dam shown in FIG. 2.
Figure 4:
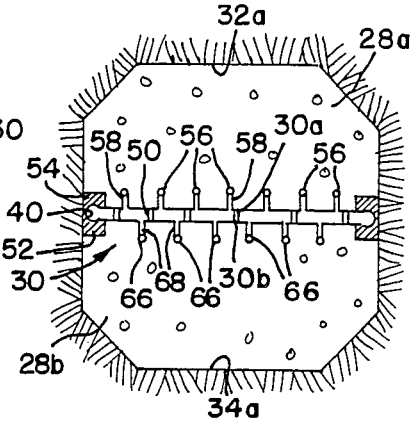
FIG. 4 is a transverse sectional view taken substantially along line 4—4 of FIG. 2.

FIGS. 2–4 illustrate an alternative embodiment of a high pressure isolation structure, indicated generally at 20, in accordance with the present invention. The high pressure isolation structure 20, which may alternatively be termed an expansion joint or bulkhead, provides an alternative method of accelerated rock repressurization and is illustrated as being positioned within an underground passageway 22 formed in rock, such as saltrock or other incompetent or insoluble rock 24. While the passageway 22, as well as the aforedescribed passageway 1, is illustrated as having a horizontal orientation, it will be understood that the passage or drift may have an inclined orientation and provide passage to a substantially larger underground cavity or chamber (not shown) which has previously been mined out or which is in the process of being mined. Alternatively, the passageway or drift 22 may comprise one of a plurality of access passages to an underground chamber as employed in the storage and isolation or high-level nuclear waste.

The expansion joint or bulkhead 20 includes a pair of generally similar shaped dam members **28*a* and 28*b* which are formed of a relatively high-strength solid material, such as concrete or other similar material, resistant to the elements, within an underground passage formed in saltrock or other incompetent of soluble rock formation and which enables pouring and hardening in situ. The dam members 28*a* and 28*b* are separated by an expansion joint, indicated generally at 30, which in the embodiment illustrated in FIG. 2 has a generally horizontal orientation and includes a pair of steel liner plates 30*a* and 30*b*. As illustrated in FIG. 4, the liner plates 30*a* and 30*b* extend substantially the full horizontal width of the upper and lower dam members 28*a* and 28*b***, respectively.

Prior to forming the high pressure isolation dam or bulkhead 20, the rock surrounding the passageway 22 is excavated or fragmented to form an expanded recess. In the illustrated embodiment, the recess has a generally octagonal transverse configuration, as illustrated in FIG. 4, with the uppermost and lowermost surfaces being defined by mutually intersecting inclined surfaces **32*a* and 32*b*, and 34*a* and 34*b*, respectively. In this manner, the isolation dam or bulkhead is fixed at a selected position along the length of the passageway. The high pressure or wet side of the bulkhead 20 and the adjacent peripheral surfaces of the passageway 22 are coated with an elastomer liner 36 similar to the aforedescribed elastomer liner 3**, which serves to prevent penetration of brine into the rock adjacent the dam or bulkhead.

Figure 7:
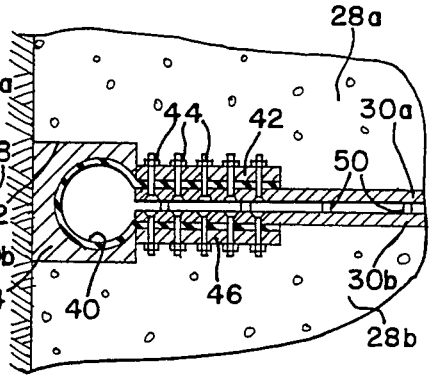
FIG. 7 is an enlarged detail view illustrating the manner of connecting corresponding outer edges of liner plates to form expansion chambers in the expansion joints employed in the embodiments of FIGS. 4 and 6.

Referring to FIGS. 4 and 7, the liner plates **30*a* and 30*b* extend substantially the full lateral width of the associated dam members 28*a* and 28*b* and have their opposite marginal edges affixed to a high pressure reinforced elastomer gasket 40 which extends along the full longitudinal lengths of the liner plates and also along their forward and rearward transverse marginal edges. The elastomer gasket 40 is of generally U-shape and has one edge portion clamped between the liner plate 30***a* and a flange plate 42 as by bolts 44. The opposite free edge portion of gasket 40 is secured between the marginal edge of liner plate 30*b* and a flange plate 46 by similar fastener bolts 44. The elastomer gasket 40 is affixed to the upper and lower liner plates 30*a* and 30*b* about their full peripheral edges so as to cooperate with the plates in establishing a substantially closed expansion chamber. A plurality of spacers, such as indicated at 50, are preferably affixed to a selected one of the opposed surfaces of the plates 30*a* and 30*b* so as to maintain at least minimal spaced relation therebetween to facilitate introduction of a pressurized fluid medium into the expansion chamber as will be described herein below.

In forming the high pressure isolation structure or bulkhead 20, suitable forms (not shown) are initially assembled within the passageway 22 to facilitate forming of the lower dam member 28b to a predetermined height, such as approximately one-half the vertical height of the bulkhead. The liner plates 30*a* and 30b and associated elastomer gasket 40 are then affixed to the upper surface of the lower dam member. Thereafter, the upper dam member 38 is formed in a conventional manner such that its upper peripheral surface engages the opposed inner surfaces of the previously created expansion joint chamber within the rock 24. The upper and lower dam members 28*a* and 28*b* are formed so as to create a generally rectangular recess or cavity, indicated at 52 in FIG. 7, of larger size than the outer dimension of the elastomer gasket 40 about the full periphery of the bulkhead. A suitable bitumen or similar material 54 is preferably injected into the recess 52 so as to encompass the outer peripheral surface of the elastomer gasket 40 while facilitating flexing of the gasket upon separation of the liner plates 32*a* and 32*b*.

To facilitate injection of a pressurized fluid medium, such as a suitable hydraulic fluid, into the expansion chamber defined between the liner plates 30*a* and 30*b*, a plurality of injection tubes or pipes 56 have communication with the expansion chamber through associated flow conduits 58 affixed to the upper surface of the liner plate 38 in communicating relation with orifices in the expansion plate. As illustrated in FIG. 2, the flow tubes 56 extend generally longitudinally of the isolation structure or bulkhead 20 and extend outwardly from an end surface 28*c* where they are connected to an injection manifold 60 adapted for connection to a source of pressurized hydraulic medium.

After forming the isolation structure or bulkhead 20 as thus described, and prior to introducing high pressure fluid into the expansion chamber between the liner plates 30*a* and 30*b*, a suitable grouting material is introduced between the outer surfaces of the upper and lower dam members 28*a* and 28*b* and the adjacent rock cavity by conventional techniques, such as through suitable conduits (not shown) formed within the dam members and through which a suitable grouting material may be introduced. The grouting effects substantially full surface contact with the rock surface peripherally of the bulkhead. Thereafter, pressurized hydraulic medium is introduced through the injection manifold 60 and distribution lines 56 and 58 into the expansion chamber between the liner plates 30*a,b* to effect selected expansion of the dam members against the adjacent rock surfaces to obtain a predetermined rock stress and prevent liquid seepage through any microfracture system existent in the rock. For example, it is known that saltrock has properties similar to asphalt and will flow when subjected to predetermined stress so as to effectively close off any seepage channels formed within the initially created microfracture. On the other hand, the pressure applied to the expansion chamber within the expansion joint 20 may be reduced to apply reduced stress to the adjacent rock surfaces when working within an elastic type rock formation.

Once a desired rock stress is achieved by the bulkhead 20, the hydraulic medium between the liner plates 30*a* and 30*b* can be displaced with grout or any epoxy and suitable hardener. For this purpose, a drainage manifold system similar to the injection manifold system is formed within the dam member 28*b* below the liner plate 30*b* to facilitate discharge of pressurized fluid medium from the expansion chamber when displaced by the grout or epoxy. A drainage manifold 64 is interconnected to discharge orifices formed uniformly throughout the liner plate 30*b* through longitudinally extending drainage tubes 66 and associated flow conduits 68 as illustrated in FIG. 2.

Figure 5:
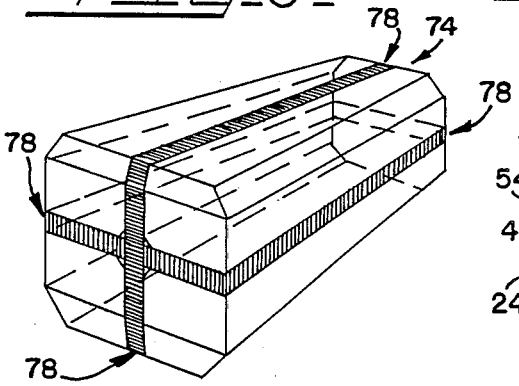
FIG. 5 is a perspective view diagrammatically illustrating a further embodiment of a high pressure isolation structure in accordance with the ivention for use in the passageway shown in FIG. 2.
Figure 6:
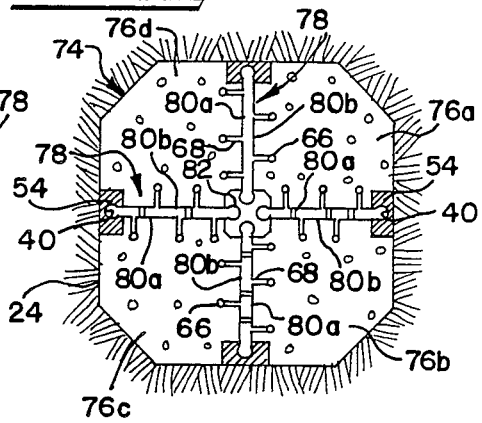
FIG. 6 is a transverse sectional view similar to FIG. 4 but illustrating the high pressure isolation structure shown diagrammatically in FIG. 5.
Figure 8:
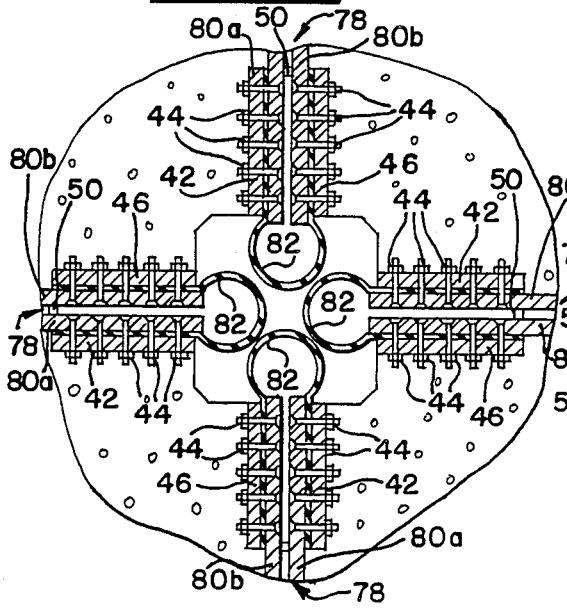
FIG. 8 is an enlarged detailed view illustrating the manner of interconnecting the inner marginal edges of the liner plates employed in the expansion joint illustrated in FIG. 6.

FIGS. 5, 6 and 8 illustrate a further embodiment of a high pressure isolation structure, indicated generally at 74, which may alternatively be termed a dam, expansion joint or bulkhead. The high pressure isolation structure 74 may be employed as an isolation dam within the passageway 22 in place of the aforedescribed isolation structure 20. The isolation structure or bulkhead 74 differs from the isolation structure 20 in that it provides for both horizontal and vertical expansion within a single isolation dam, and in some installations may provide improved rock integrity and dam performance in isolating a mining chamber or storage isolation cavity below ground from intrusion of liquids through the passageway 22.

The isolation structure or bulkhead 74 has four similarly configured impervious dam members 76*a–d* which are maintained in assembled relation by associated expansion joints, each of which is indicated generally at 78, so as to form a bulkhead having four similar quadrants when veiwed from an end thereof or in transverse section as illustrated in FIGS. 5 and 6. The expansion joints 78 are generally similar to the aforedescribed expansion joint 30 and need not be described in greater detail herein. Suffice it to say that each of the expansion joints 78 includes a pair of spaced generally planar liner plate 80*a* and 80*b* which are maintained in spaced relation by suitable spacers and which have their outer marginal edges interconnected through elastomer gaskets 40. The corresponding inner marginal edges of each pair of liner plates 80*a* and 80*b* are interconnected by similar high pressure reinforced elastomer gaskets 82 affixed to the respective pairs of plates 80*a* and 80*b* in similar fashion to the elastomer gaskets 40. The elastomer gaskets 82 are received within a central longitudinally extending cavity 84 formed centrally of the dam members 76*a–d*.

Similarly, the spaced liner plates 80*a* and 80*b* of each of the expansion joints 78 are cooperative with injection manifolds and associated drainage manifolds to facilitate introduction of suitable hydraulic medium between the respective pairs of plates for effecting outward expansion of the dam members 76*a–d* into pressure engagement with the adjacent rock surface to obtain desired stress within the rock surface and closing of the microfracture system therein. It will be understood that a suitable grouting material is introduced between the dam members 76*a–d* and the adjacent rock surface prior to expansion of the dam members, as was described in conjunction with the high pressure isolation structure 20. The hydraulic fluid introduced into the expansion joint of FIGS. 5, 6 and 8 may also be replaced with a hardenable grouting material to effect a fixed isolation dam of long duration.

The high pressure isolation structures or expansion joints 20 and 74 can be used to replace one or both of the isolation dams illustrated at 5 and 6 in FIG. 1, or they could be used separately in a single dam or bulkhead application. In either usage, the high pressure isolation structures 20 and 74 enable relatively rapid forming or installation within an underground passageway and are of long duration.

While preferred embodiments of the present invention have been illustrated and described, it will be understood that changes and modifications may be made therein without departing from the invention in its broader aspects. Various features of the invention are defined in the following claims.

What is claimed is:

1. An isolation structure for use in an underground passage defined within a rock formation having a microfracture system through which liquid seepage may occur, said isolation structure comprising a plurality of dam members, expansion joint means operatively interconnecting said dam members in predetermined surface adapted for substantial surface contact with an inner peripheral surface of said underground passage when disposed therein, said expansion joint being operative to effect movement of said dam members when disposed within said underground passage to effect pressurized engagement between said external surfaces of said dam members and the inner peripheral surface of said passage whereby to enable predetermined stress to be achieved in the rock formation.

2. An isolation structure as defined in claim 1 wherein said expansion joint includes a pair of generally parallel liner plates affixed to said dam members on mutually opposed surfaces thereof, and gasket means cooperative with the peripheral edges of said linner plates so as to establish a substantially closed chamber between said plates adapted to receive a fluid medium therein to effect selective separation of said plates and expansion of said dam members.

3. An isolation structure defined in claim 2 including spacer means interposed between said liner plates so as to maintain said liner plates in spaced relation.

4. An isolation structure as defined in claim 2 including injection manifold means operatively associated with said chamber defined between said liner plates so as to facilitate selective introduction of pressurized fluid medium into said chamber.

5. An isolation structure as defined in claim 4 including drainage manifold means operatively associated with said liner plates in a manner to facilitate drainage of fluid medium from said chamber defined between said liner plates.

6. An isolation structure as defined in claim 1 comprising two dam members of substantially similar configuration, said expansion joint means interconnecting said dam members and defining a generally longitudinal median plane therebetween.

7. An isolation structure as defined in claim 6 wherein said liner plates are substantially planar and each is affixed to one of said two dam members along a generally planar surface thereof, and including a flexible gasket extending about the periphery of said liner plates and defining therewith a substantially closed internal chamber adapted to receive said hydraulic medium therein.

8. An isolation structure as defined in claim 1 including four dam members of generally similar configuration, said expansion joint means interconnecting said four dam members so as to define two substantailly mutually perpendicular longitudinally extending median planes through said isolation structure, said expansion joint means being adapted for cooperation with a pressurized fluid medium so as to enable selective expansion of said dam members to selectively increase the outer circumferential dimension thereof.

9. An isolation structure as defined in claim 1 wherein said dam members define a polygonal external peripheral surface.

10. An isolation structure as defined in claim 9 wherein said polygonal configuration comprises an octagon.

11. In an underground passage defined within a rock formation having a microfractrue system through which liquid seepage may occur, a high pressure isolation structure comprising a plurality of dam members, expansion joint means operatively interconnecting said dam members in predetermined relation, said dam members defining an external peripheral surface adapted for substantial surface contact with an opposed inner peripheral surface of said passage proximate said microfracture system, and means operative to effect expansion of said expansion joint means so as to effect pressurized engagement between said external surfaces of said dam members and said inner surface of said passage whereby to enable predetermined stress application to the rock formation at said microfracture system.

12. A method for isolating an underground cavity such as a passageway formed within a rock formation having a microfracture system so as to prevent liquid seepage into said cavity, said method comprising the steps of:

forming a high pressure isolation structure at a predetermined position within said passage contiguous to said microfracture system, said isolation structure including a plurality of dam members, and expanion joint means operatively associated with said dam members in a manner to enable relative movement therebetween, said members defining a substantially continuous outer peripheral surface adapted for surface engagement with said passage wall having said microfracture system therein, and effecting expansion of said expansion joint means in a manner to effect outward movement of said dam members so as to effect pressurized engagement with said wall surface to effect predetermined stress within said wall formation having said microfracture system therein.

* * * * *

UNITED STATES PATENT AND TRADEMARK OFFICE

CERTIFICATE OF CORRECTION

PATENT NO. : 4,784,522

DATED : November 15, 1988

INVENTOR(S) : Dennis Mraz

It is certified that error appears in the above-identified patent and that said Letters Patent is hereby corrected as shown below:

Column 2, line 32, "frist" should be --first--.

Column 7, line 31, "predetermined surface" should read --predetermined relation, said dam members defining an external peripheral surface--.

Signed and Sealed this

Eleventh Day of April, 1989

*Attest:*

DONALD J. QUIGG

*Attesting Officer*

*Commissioner of Patents and Trademarks*